US010206480B2

(12) United States Patent
Kim et al.

(10) Patent No.: US 10,206,480 B2
(45) Date of Patent: Feb. 19, 2019

(54) POROUS PAD FOR IMPREGNATION OF LIQUID COSMETIC COMPOSITION AND LIQUID-COSMETIC-COMPOSITION IMPREGNATING METHOD USING THE SAME

(71) Applicant: CTK CO., LTD., Seongnam-si, Gyeonggi-do (KR)

(72) Inventors: Jin Woo Kim, Gwangmyeong-si (KR); In Yong Chung, Seoul (KR)

(73) Assignees: CTK CO., LTD., Seongnam-si, Gyeonggi-Do (KR); Jin Woo Kim, Gwangmyeong-si, Gyeonggi-Do (KR)

( * ) Notice: Subject to any disclaimer, the term of this patent is extended or adjusted under 35 U.S.C. 154(b) by 249 days.

(21) Appl. No.: 14/909,727

(22) PCT Filed: Nov. 12, 2014

(86) PCT No.: PCT/KR2014/010854
§ 371 (c)(1),
(2) Date: Feb. 2, 2016

(87) PCT Pub. No.: WO2015/105268
PCT Pub. Date: Jul. 16, 2015

(65) Prior Publication Data

US 2016/0183660 A1 Jun. 30, 2016

(30) Foreign Application Priority Data

Jan. 8, 2014 (KR) ..... 10-2014-0002304

(51) Int. Cl.
*A45D 37/00* (2006.01)
*A45D 33/00* (2006.01)
*A45D 40/22* (2006.01)

(52) U.S. Cl.
CPC ..... *A45D 37/00* (2013.01); *A45D 33/006* (2013.01); *A45D 40/22* (2013.01); *A45D 2200/1036* (2013.01)

(58) Field of Classification Search
CPC .... A45D 33/00; A45D 33/003; A45D 33/005; A45D 33/006; A45D 37/00; A45D 40/00;
(Continued)

(56) References Cited

U.S. PATENT DOCUMENTS 2,317,662 A * 4/1943 Zimmerman ..... A45D 33/34 401/200
2,829,393 A * 4/1958 Turcotte ..... A45D 34/04 15/145

(Continued)

FOREIGN PATENT DOCUMENTS

KR 20-0448873 Y1 5/2010
KR 10-2012-0065982 A 6/2012

(Continued)

*Primary Examiner* — Andrew M Tecco
*Assistant Examiner* — Nicholas Igbokwe
(74) *Attorney, Agent, or Firm* — John K. Park; Park Law Firm

(57) ABSTRACT

There are provided a porous pad for the impregnation of a liquid cosmetic composition and a liquid-cosmetic-composition impregnating method using such a porous pad. The porous pad includes a first porous pad layer and a second porous pad layer. An injection hole is formed in the first porous pad layer for the injection of the liquid cosmetic composition. The second porous pad layer is disposed under the first porous pad layer, and has a dispersion hole for the dispersion of the liquid cosmetic composition that is injected through the injection hole, and one or more main storage holes that are radially arranged around the periphery of the dispersion hole.

16 Claims, 7 Drawing Sheets

(58) Field of Classification Search
CPC .. A45D 40/22; A45D 2200/1036; B65B 5/10; B65B 25/00; B65B 35/50
USPC ..... 53/431, 443, 446, 447, 474, 475; 401/196, 201–202, 203–206, 265; 15/104.93, 244.1–244.4
See application file for complete search history.

(56) References Cited

U.S. PATENT DOCUMENTS

| | | | | | |
|---|---|---|---|---|---|
| 3,570,036 | A * | 3/1971 | Gilchrist | A47L 17/08 | 15/104.94 |
| 4,595,502 | A * | 6/1986 | Himmelsbach | A47J 31/08 | 206/499 |
| 6,006,761 | A * | 12/1999 | Meledandri | A45D 33/34 | 132/317 |
| 6,685,376 | B2 * | 2/2004 | Weihrauch | A47L 13/16 | 15/244.1 |
| 8,430,724 | B2 * | 4/2013 | Heilian | B24D 11/00 | 15/229.11 |
| 2003/0123919 | A1 * | 7/2003 | Gueret | A45D 34/00 | 401/130 |
| 2009/0205673 | A1 * | 8/2009 | Richardson | A45D 33/006 | 132/307 |
| 2009/0272400 | A1 * | 11/2009 | Park | A45D 33/006 | 132/298 |
| 2011/0014254 | A1 * | 1/2011 | Choi | A61K 8/0208 | 424/401 |

FOREIGN PATENT DOCUMENTS

| | | | |
|---|---|---|---|
| KR | 10-1295166 | B1 | 8/2013 |
| WO | 2013-105804 | A1 | 7/2013 |

* cited by examiner

[Fig. 1]
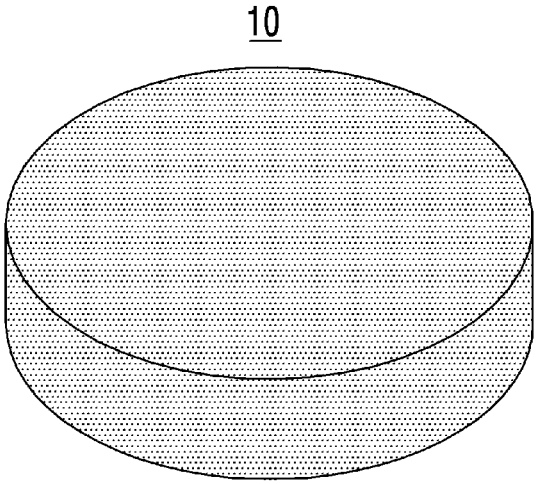
[Fig. 2]
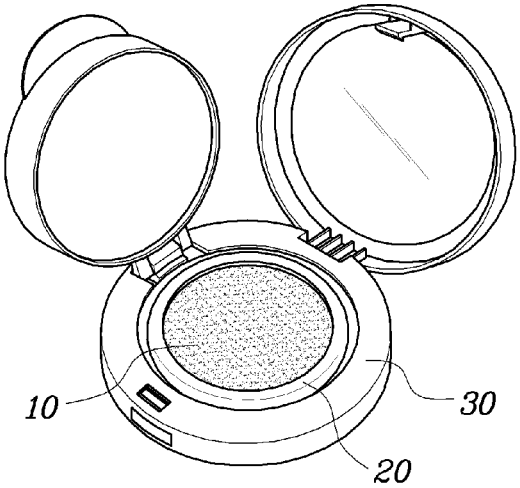

[Fig. 3]
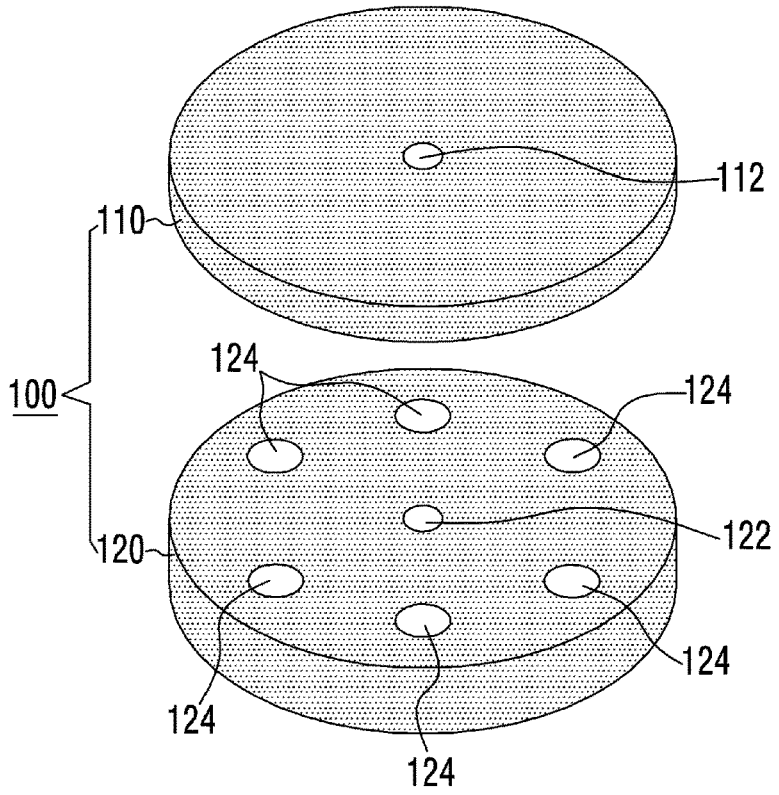
[Fig. 4]
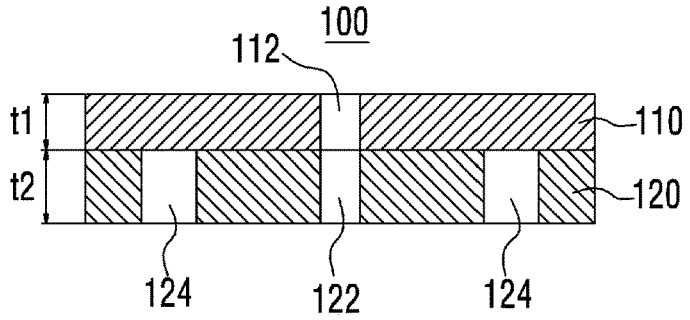
[Fig. 5A]
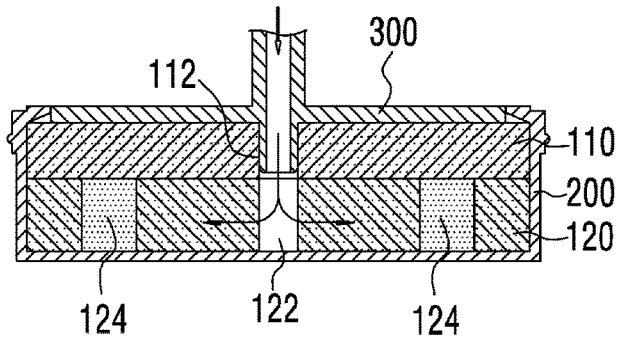

[Fig. 5B]
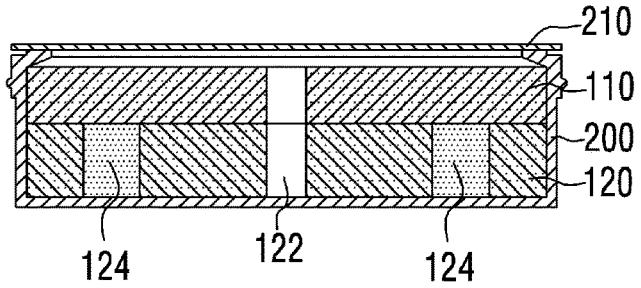
[Fig. 6]
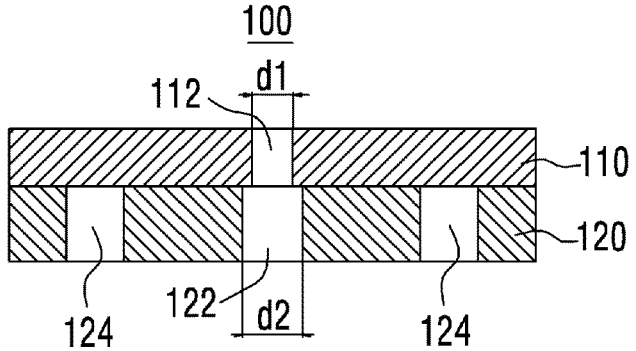
[Fig. 7]
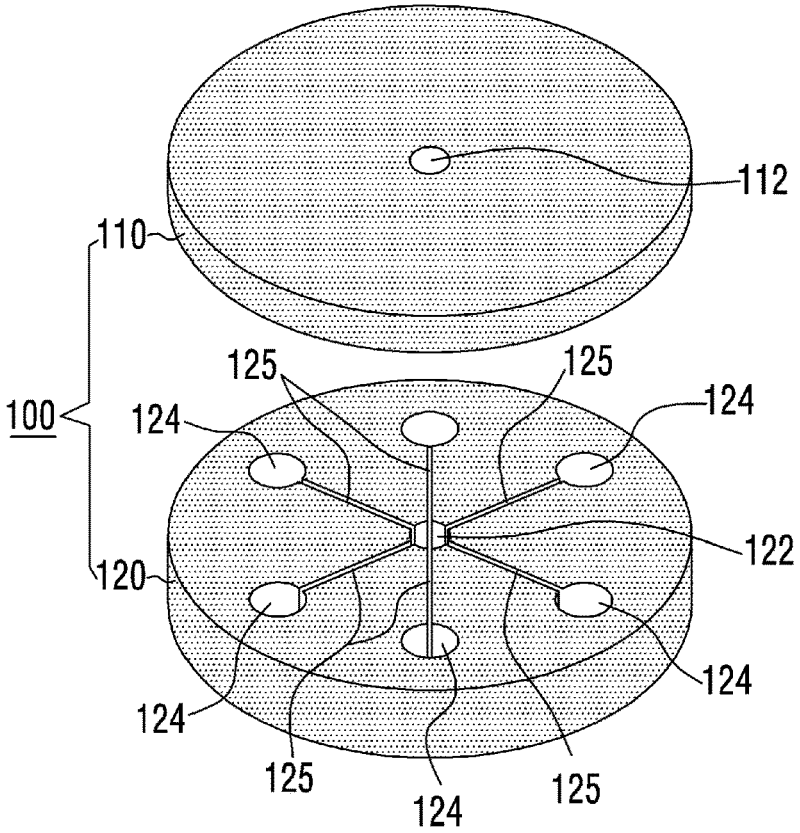

[Fig. 8]
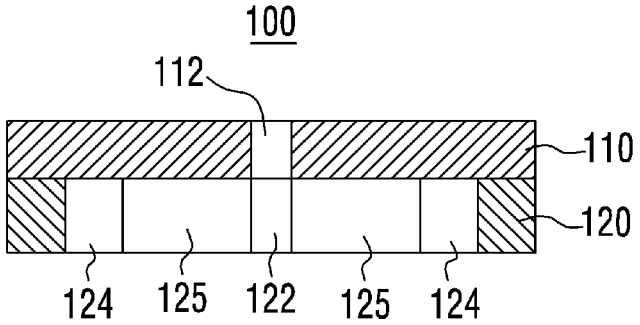
[Fig. 9]
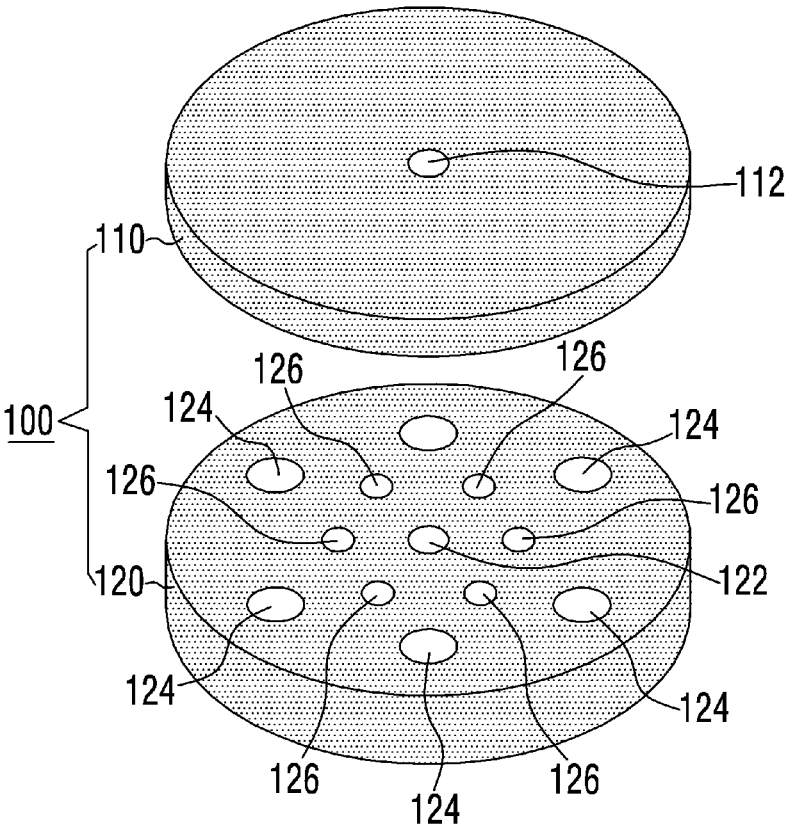

[Fig. 10]
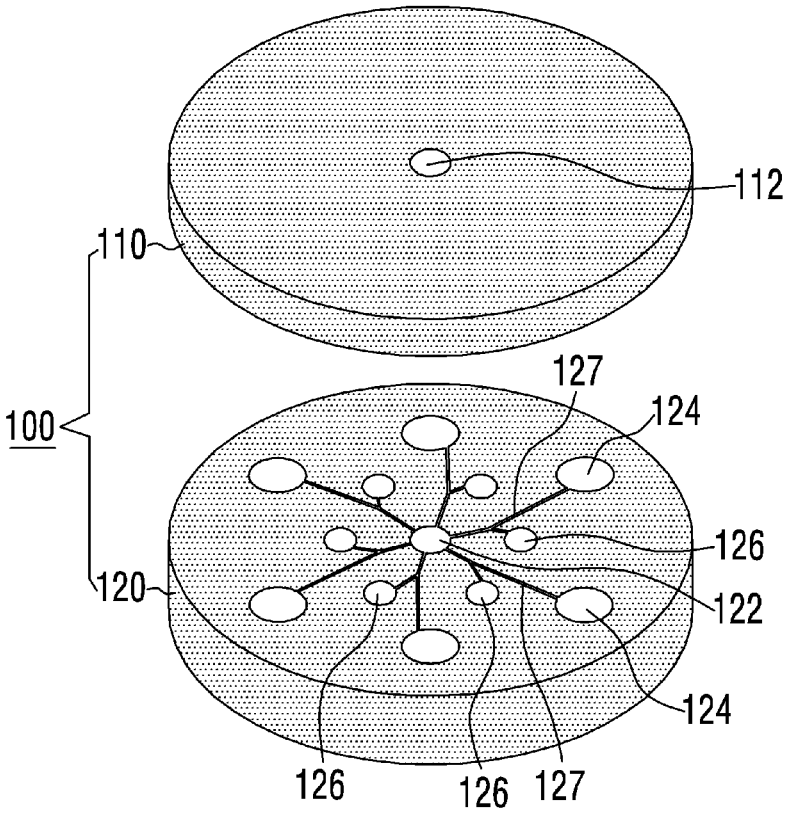

[Fig. 11]
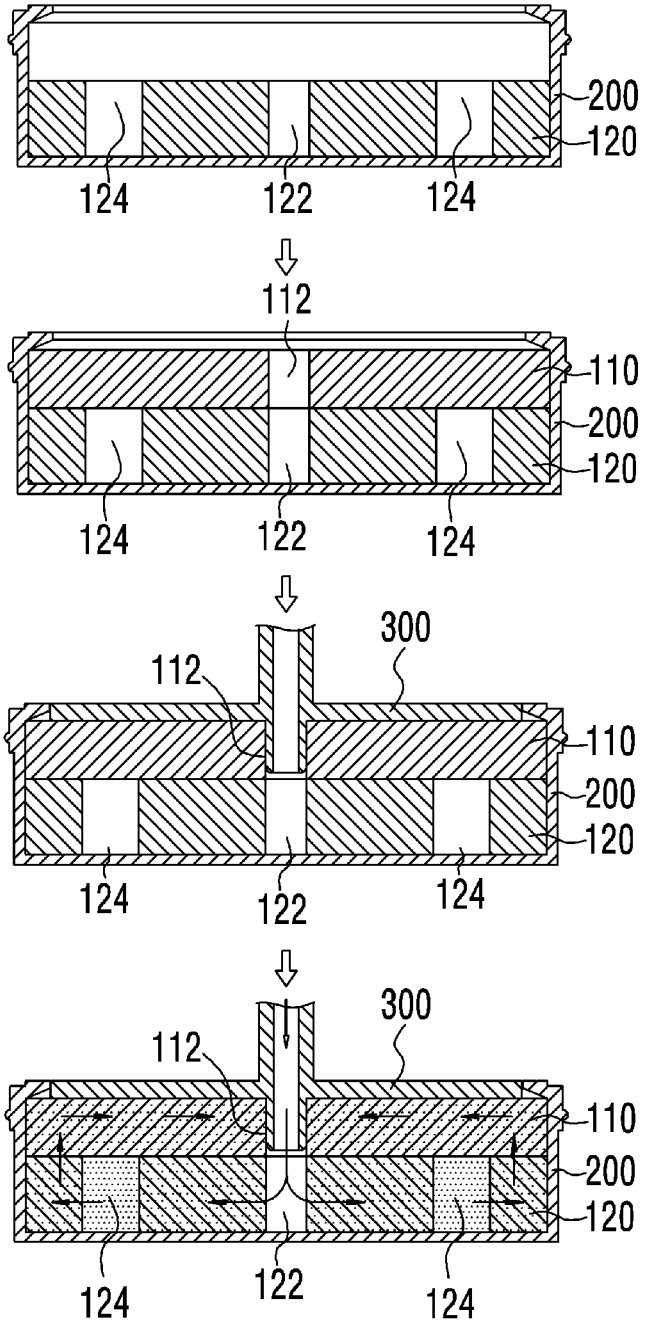

[Fig. 12]
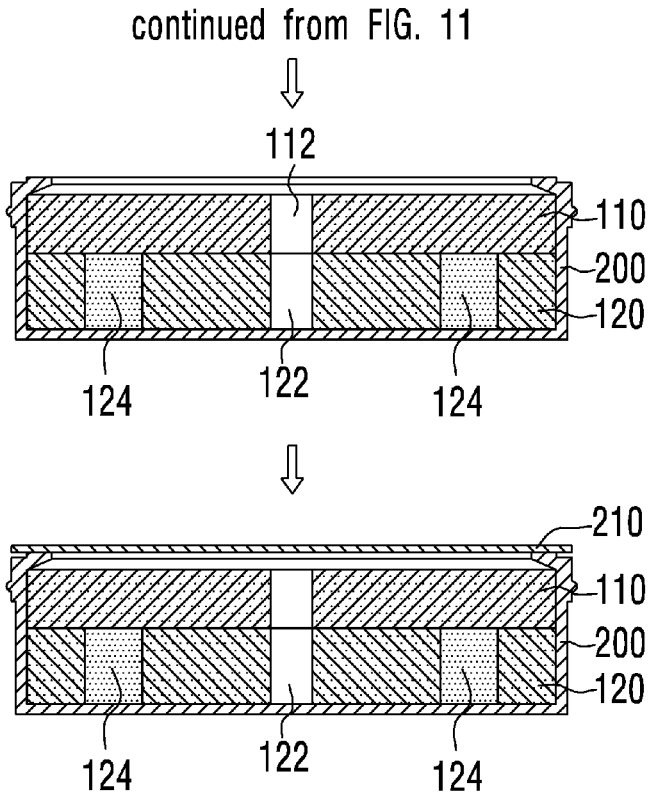

POROUS PAD FOR IMPREGNATION OF LIQUID COSMETIC COMPOSITION AND LIQUID-COSMETIC-COMPOSITION IMPREGNATING METHOD USING THE SAME

TECHNICAL FIELD

The present invention relates to a porous pad which is configured to enable the rapid filling and dispersion of a liquid cosmetic composition and to have one or more layers so as to increase a filling capacity, and to a liquid-cosmetic-composition impregnating method using such a porous pad.

BACKGROUND ART

Recently, in a cosmetic field, a liquid cosmetic composition containing moisture and oil therein is being developed. Various methods of containing the liquid cosmetic composition have been developed. By way of example, as shown in FIG. 1, currently, a preferential method involves the impregnation of a porous pad 10, made of various materials including sponge or urethane foam as a carrier. Further, as shown in the photograph of FIG. 2, the porous pad impregnated with the liquid cosmetic composition is usually accommodated in a refill case 20 which is mounted to a compact type cosmetic container 30 for the refilling purpose.

The conventional porous pad impregnated with the liquid cosmetic composition is contained in the refill case as shown in the photograph of FIG. 2 rather than in the cosmetic container, so that its size is restricted. That is, the size of the porous pad may vary slightly according to the refill-case manufacturing company. Further, given that the refill case is usually mounted to the existing compact type cosmetic container, it is impossible to indefinitely increase its size as desired. Thus, the refill case should be inevitably designed to be held in the conventional compact type cosmetic container. Thereby, the porous pad should be likewise manufactured within a range that is suitable to be accommodated in the refill case. In view of this, the porous pad is designed such that its diameter ranges from about 40 to 50 mm and its thickness ranges from about 10 to 20 mm.

Therefore, since the porous pad having the above size should be impregnated with the liquid cosmetic composition, a method of very rapidly and effectively impregnating the porous pad with the liquid cosmetic composition is required. There are proposed the following conventional methods: a method of filling the porous pad with the liquid cosmetic composition using a separate filling installation and then receiving the porous pad in the refill case, and a method of directly putting the single porous pad into the refill case and then pouring the liquid cosmetic composition little by little to fill the porous pad with it.

However, the former method is problematic in that the separate filling installation is required, so that it is uneconomical, and in that the pad should be received in the refill case again, thus causing inconvenience in transport and operation. Further, the latter method is problematic in that, as the porous pad is impregnated with the liquid cosmetic composition with it being received in a receiving portion of the refill case, the filling operation should be slowly performed according to the degree to which the porous pad is impregnated with the liquid cosmetic composition, so that an operation speed at which the liquid cosmetic composition is filled is unavoidably reduced, thus considerably deteriorating the productivity of a product. Such deterioration in productivity results in rising manufacturing cost. Further, the former and latter methods of filling the porous pad with the liquid cosmetic composition are problematic in that the porous pad is simply impregnated using a net structure, so that it is difficult to obtain a sufficient filling amount of liquid cosmetic composition and thereby the service life of a product is shortened, with the result that consumers should frequently re-purchase the product. Consequently, the methods lead to a high degree of complexity and inconvenience.

DOCUMENTS OF RELATED ART

Patent Document 1

Korean Patent Application Publication No. 10-2013-0001688

DISCLOSURE OF INVENTION

Technical Problem

Accordingly, the present invention has been made keeping in mind the above problems occurring in the related art, and is intended to provide a porous pad, which allows a liquid-cosmetic-composition impregnating operation to be very rapidly carried out even in a state where the porous pad is directly received in a refill container and is composed of one or more layers to provide a sufficient filling capacity, and is intended to provide a liquid-cosmetic-composition impregnating method using such a porous pad.

Solution to Problem

In an aspect, the present invention provides a porous pad for impregnation of a liquid cosmetic composition, including a first porous pad layer; and a second porous pad layer disposed under the first porous pad layer, wherein the first porous pad layer comprises an injection hole for injection of the liquid cosmetic composition, and the second porous pad layer comprises a dispersion hole and one or more main storage holes, the dispersion hole being coaxially formed through the second porous pad layer to disperse the liquid cosmetic composition that is injected through the injection hole, the main storage holes being formed through the second porous pad layer in such a way as to be located around a periphery of the dispersion hole and be radially arranged.

According to the present invention, the first porous pad layer may be formed to be thinner than the second porous pad layer.

According to the present invention, the dispersion hole of the second porous pad layer may be formed to be larger than the injection hole of the first porous pad layer.

According to the present invention, a passage may be connected between the dispersion hole of the second porous pad layer and each of the main storage holes that are radially located around the periphery of the dispersion hole to guide rapid dispersion and filling of the liquid cosmetic composition.

According to the present invention, the porous pad may further include auxiliary storage holes formed in the second porous pad layer to increase a filling amount of the liquid cosmetic composition, each of the auxiliary storage holes having a diameter smaller than that of each of the main storage holes.

According to the present invention, the auxiliary storage holes formed in the second porous pad layer may be distributed at regular intervals between the respective main storage holes so as to guide uniform dispersion of the liquid cosmetic composition.

According to the present invention, passages may be connected between the main storage holes and the auxiliary storage holes of the second porous pad layer so as to guide rapid dispersion and filling of the liquid cosmetic composition from the central dispersion hole, one passage being connected between each of the main storage holes and each of the auxiliary storage holes.

According to the present invention, each of the first and second porous pad layers may be sponge.

In another aspect, the present invention provides a method of impregnating a porous pad with a liquid cosmetic composition, including receiving a second porous pad layer in a lower portion of a refill container, the second porous pad layer having a dispersion hole formed through a center thereof and one or more main storage holes formed through the second porous pad layer in such a way as to be radially arranged around a periphery of the dispersion hole; receiving a first porous pad layer to be disposed above the second porous pad layer, with an injection hole formed through the first porous pad layer to inject the liquid cosmetic composition being arranged to be coaxial with the dispersion hole of the second porous pad layer; fitting a nozzle of a filling mechanism into the injection hole of the first porous pad layer to supply the liquid cosmetic composition; injecting the liquid cosmetic composition into the dispersion hole of the second porous pad layer using the filling mechanism; performing filling and impregnating operations so that the liquid cosmetic composition permeates the second porous pad layer while continuing to inject the liquid cosmetic composition through the dispersion hole, and simultaneously storing a predetermined amount of liquid cosmetic composition in each of the main storage holes; removing the filling mechanism from the first porous pad layer after the filling of the liquid cosmetic composition is completed; and sealing an upper surface of the refill container with a sealing member after the filling mechanism has been removed.

Advantageous Effects of Invention

As described above, the present invention is advantageous in that the porous pad filled with the liquid cosmetic composition is formed in two layers, and the injection hole, the dispersion hole and the main storage hole are formed in each pad for the injection, filling and impregnation of the liquid cosmetic composition, thus allowing the liquid-cosmetic-composition filling and impregnating operations to be rapidly carried out, and simultaneously increasing the filling amount, and in that the porous pad is configured to be divided into first and second porous pad layers, thus facilitating the rapid liquid-cosmetic-composition filling and impregnating operations even in the state where the porous pad is directly received in the refill container; thereby improving the productivity of the product.

BRIEF DESCRIPTION OF DRAWINGS

FIG. 1 is a perspective view showing a conventional porous pad;

FIG. 2 is a photograph showing a state where the conventional porous pad mounted to a refill container is mounted to a cosmetic container;

FIG. 3 is an exploded perspective view showing a porous pad according to the present invention;

FIG. 4 is a side sectional view of FIG. 3;

FIG. 5A is a side sectional view showing a state where the porous pad is filled with a liquid cosmetic composition using a filling mechanism with the porous pad according to the present invention being received in a refill container;

FIG. 5B is a side sectional view showing a state where the filling mechanism is detached after the porous pad according to the present invention has been filled with the liquid cosmetic composition, and then a sealing operation is performed by a sealing member;

FIG. 6 is a side sectional view showing another structure of a dispersion hole formed in a second porous pad layer according to the present invention;

FIG. 7 is a plan view showing a structure of the second porous pad layer according to another embodiment of the present invention;

FIG. 8 is a side sectional view of FIG. 7;

FIG. 9 is a plan view showing a structure of the second porous pad layer according to a further embodiment of the present invention;

FIG. 10 is a plan view showing a structure of the second porous pad layer according to another embodiment of the present invention; and FIGS. 11 and 12 are process charts showing the steps of impregnating the porous pad according to the present invention with the liquid cosmetic composition.

MODE FOR THE INVENTION

Hereinbelow, preferred embodiments of the present invention will be described in detail with reference to the accompanying drawings.

Referring to FIG. 3 to FIGS. 5A and 5B, a porous pad 100 impregnated with a liquid cosmetic composition according to the present invention is divided into two layers. That is, the pad is divided into a first porous pad layer 110 having a predetermined thickness and size, and a second porous pad layer 120 having a predetermined thickness and size.

An injection hole 112 is formed through a center of the first porous pad layer 110. Further, a dispersion hole 122 is formed through a center of the second porous pad layer 120. One or more main storage holes 124 are formed around the periphery of the dispersion hole 122 in such a way as to be radially distributed.

When received in a refill container 200, the first porous pad layer 110 is located at an upper position to serve as a cover, and the second porous pad layer 120 is disposed under the first porous pad layer 110 to be substantially impregnated and filled with the liquid cosmetic composition.

The porous pad is formed in two layers such that the thickness of the first and second porous pad layers 110 and 120 is within a thickness of a conventional single porous pad, and the diameter of the first and second porous pad layers 110 and 120 is likewise within a diameter of a conventional single porous pad.

For example, the size or diameter of the first and second porous pad layers 110 and 120 ranges from 40 to 50 mm, and the total thickness ranges from 10 to 20 mm. Here, the thickness t1 of the first porous pad layer and the thickness t2 of the second porous pad layer may be identical to or different from each other as necessary as long as the sum of the thickness 1 and the thickness 2 is within the total thickness.

According to the present invention, the thickness t2 of the second porous pad layer 120 is preferably larger than the thickness t1 of the first porous pad layer 110. The reason is because the second porous pad layer 120 is substantially impregnated with the liquid cosmetic composition. In other words, the thicker the second porous pad layer is, the larger the impregnation and filling capacity of the liquid cosmetic composition is.

The dispersion hole 122 formed in the second porous pad layer 120 is arranged to be coaxial with the injection hole 112 of the first porous pad layer 110. Such an arrangement allows the liquid cosmetic composition injected through the injection hole to be immediately dispersed and supplied through the dispersion hole which is located right under the injection hole. Preferably, the injection hole 112 formed in the first porous pad layer 110 has the same size as the dispersion hole 122 formed in the second porous pad layer 120. However, this invention is not limited thereto.

Preferably, as shown in FIG. 6, a diameter d2 of the dispersion hole 122 formed in the second porous pad layer 120 may be larger than a diameter d1 of the injection hole 112 formed in the first porous pad layer 110 such that the liquid cosmetic composition injected through the injection hole 112 of the first porous pad layer 11 can be rapidly absorbed and stored.

Referring to FIG. 5A, the porous pad 100 according to the present invention is filled and impregnated with the liquid cosmetic composition in the state where the first and second porous pad layers 110 and 120 are directly accommodated in the refill container 200. At this time, the second porous pad layer 120 is accommodated in a lower portion, while the first porous pad layer 110 is accommodated in an upper portion. The liquid cosmetic composition is evenly dispersed through the dispersion hole 122 of the second porous pad layer 120 to the periphery via a filling mechanism 300 that is put in the injection hole 112 of the first porous pad layer 110. Through such a dispersion process, the impregnation of the liquid cosmetic composition is performed through a pore of the first porous pad layer 120. Simultaneously, during the impregnation process, some of the liquid cosmetic composition is collected and stored in the main storage hole 124. Further, the liquid cosmetic composition impregnated in the second porous pad layer 120 naturally permeates and impregnates the second porous pad layer 110 located in the upper portion.

Since only the injection hole 112 in which the filling mechanism 300 is put is formed in the first porous pad layer 110 disposed above the second porous pad layer, the first porous pad layer serves to cover the second porous pad layer 120. Thus, this prevents the liquid cosmetic composition filled and stored in the main storage hole 124 of the second porous pad layer 120 from overflowing.

Therefore, in the case of using the porous pad 100 according to the present invention, even if the filling and impregnating operation of the liquid cosmetic composition is performed with the porous pad 100 being directly accommodated in the refill container 200, the structure of the first and second porous pad layers 110 and 120 allows for the rapid filling and impregnating operation without overflow, thus making it possible to manufacture the cosmetics using the liquid cosmetic composition very rapidly and conveniently.

Further, if the porous pad 100 accommodated in the refill container 200 has been filled and impregnated with the liquid cosmetic composition, as shown in FIG. 5B, the filling mechanism 300 is removed and then the upper surface of the refill container is sealed by a sealing member 210. Thereby, the manufacture of the cosmetics using the liquid cosmetic composition is completed.

Meanwhile, referring to FIGS. 7 and 8, the second porous pad layer 120 according to the present invention may be implemented differently from the above-mentioned configuration. For example, a passage 125 is preferably connected between the dispersion hole 122 of the second porous pad layer 120 and each of the main storage holes 124 that are radially arranged around the periphery of the dispersion hole 122 to facilitate the rapid dispersion, impregnation, and filling of the liquid cosmetic composition.

As such, the passage 125 is further formed to allow the liquid cosmetic composition supplied through the dispersion hole 122 to be rapidly supplied to and stored in each main storage hole 124. In addition, while the liquid cosmetic composition flows through the passage, it is dispersed to surroundings, thus allowing the filling and dispersion of the liquid cosmetic composition to be more effectively realized.

Further, referring to FIG. 9, the second porous pad layer 120 may be implemented differently from the above-mentioned configuration. For example, auxiliary storage holes 126 may be further formed in the second porous pad layer 120. Each auxiliary storage hole has a smaller diameter than that of the main storage hole 124 so as to increase the filling amount of the liquid cosmetic composition. Here, the position at which each auxiliary storage hole 126 is formed is not limited to a specific position. However, in order to realize the uniform dispersion and filling of the liquid cosmetic composition, the auxiliary storage holes 126 are preferably arranged at regular intervals between the respective main storage holes 124.

As such, the second porous pad layer 120 additionally having the auxiliary storage holes 126 can be filled with a larger amount of liquid cosmetic composition as compared to the second porous pad layer having only the main storage holes. This allows the filling and impregnating operations of the liquid cosmetic composition to be more rapidly performed.

Further, referring to FIG. 10, the second porous pad layer 120 may be implemented differently from the above-mentioned configuration. For example, a passage 127 is connected between each main storage hole 124 of the second porous pad layer 120 and each auxiliary storage hole 126 to allow for the rapid dispersion, impregnation and filling of the liquid cosmetic composition from the central dispersion hole 122. One passage is preferably connected between each main storage hole and each auxiliary storage hole.

As such, each of the main storage holes 124 and each of the auxiliary storage holes 126, which are radially arranged around the periphery of the dispersion hole 122, are connected to each other via one passage 127, thus allowing the liquid cosmetic composition to be more rapidly supplied to the main storage holes 124 as well as the auxiliary storage holes 126. During the supply of the liquid cosmetic composition, it very rapidly permeates the surroundings, thus allowing the impregnating operation of the liquid cosmetic composition to be more rapidly and easily carried out.

According to the present invention, the porous pad 100 may have various shapes in conformity with the shape of the receiving portion of the refill container 200. In addition, the injection hole 112, the dispersion hole 122, the main storage hole 124, and the auxiliary storage hole 126 formed in the first and second porous pad layers 110 and 120 may have various shapes including a circular shape.

According to the present invention, the first and second porous pad layers 110 and 120 may be made of various materials, and preferably made of sponge that is good in elasticity and excellent in moisture absorbing ability.

Next, the method of impregnating the porous pad 100 with the liquid cosmetic composition according to the present invention will be described with reference to FIGS. 11 and 12.

The method of impregnating the porous pad 100 with the liquid cosmetic composition according to the present invention includes the steps of:

receiving the second porous pad layer 120 in the lower portion of the refill container 200, the second porous pad layer having the dispersion hole 122 that is formed through the central thereof and one or more main storage holes 124 that are formed through the second porous pad layer in such a way as to be radially arranged around the periphery of the dispersion hole;

receiving the first porous pad layer 110 to be superposed above the second porous pad layer 120, with the injection hole 112 formed through the first porous pad layer to inject the liquid cosmetic composition being arranged to be coaxial with the dispersion hole 122 of the second porous pad layer 120;

fitting a nozzle of the filling mechanism 300 into the injection hole 112 of the first porous pad layer 110 to supply the liquid cosmetic composition;

injecting the liquid cosmetic composition into the dispersion hole 122 of the second porous pad layer 120 using the filling mechanism;

performing filling and impregnating operations so that the liquid cosmetic composition permeates the second porous pad layer 120 while continuing to inject the liquid cosmetic composition through the dispersion hole 122, and simultaneously storing a predetermined amount of liquid cosmetic composition in each of the main storage holes 124;

removing the filling mechanism 300 from the first porous pad layer 110 after the filling of the liquid cosmetic composition is completed; and sealing the upper surface of the refill container 200 with the sealing member 210 after the filling mechanism has been removed.

Through the above-mentioned impregnating process, the first and second porous pad layers 110 and 120 constituting the porous pad 100 may be evenly filled and impregnated with the liquid cosmetic composition in the refill container 200. The liquid cosmetic composition is stored in the main storage holes 124 formed in the second porous pad layer 120.

The above-mentioned embodiments may be naturally applied to the second porous pad layer 120 that is utilized in the liquid-cosmetic-composition impregnating process.

That is, as shown in FIGS. 7 to 10, the passage 125 may be formed between the dispersion hole 122 and each of the main storage holes 124, or the auxiliary storage holes 126 may be further formed, or each of the main storage holes 124 and each of the auxiliary storage holes 126 may be connected to each other via one passage 127 to allow the liquid cosmetic composition for filling to flow more smoothly. As such, it is possible to use the second porous pad layer 120 having various structures.

According to the present invention, even though the liquid cosmetic composition is rapidly injected into the porous pad 100 that is directly received in the refill container 200 using the filling mechanism 300, a further amount of the liquid cosmetic composition is filled and stored in addition to the porous pad being evenly impregnated with the liquid cosmetic composition via one of more main storage holes 124 formed in the second porous pad layer 120. Hence, it is not necessary to perform the injecting operation while checking the degree at which the porous pad is impregnated with the liquid cosmetic composition as in the prior art.

Since the amount at which the porous pad 100 is filled using the filling mechanism 300 is selected by adjusting a pressure or an injecting amount based on the result obtained through various pre-tests, the excessive filling or overflowing is prevented.

Meanwhile, when comparing the filling amount of the porous pad 100 according to the present invention with that of the conventional sponge type porous pad (see, FIG. 1), it is shown that the former is about 1.5 to 1.8 times as much as the latter. The reason is because the filling amount of the liquid cosmetic composition is increased by the main storage holes 124 formed in the second porous pad layer 120.

Therefore, in the method of impregnating the porous pad with the liquid cosmetic composition according to the present invention, the filling and impregnating structure of the porous pad is modified, thus preventing the liquid cosmetic composition from overflowing the refill container although the filling and impregnating operations of the liquid cosmetic composition are rapidly performed after the porous pad 100 composed of the first and second porous pad layers 110 and 120 is directly accommodated in the refill container 200 at the time of manufacturing the cosmetics using the liquid cosmetic composition, thereby enabling the cosmetics to be rapidly manufactured.

Further, during the filling of the liquid cosmetic composition, the main storage holes 124 or the auxiliary storage holes 126 formed in the second porous pad layer 120 allow a larger amount of liquid cosmetic composition to be stored, thus providing a sufficient filling amount. This can prolong the service life of cosmetics, thus reducing a frequency at which consumers should purchase the cosmetics.

DESCRIPTION OF REFERENCE NUMERALS OF IMPORTANT PARTS

100: porous pad 110: first porous pad layer
112: injection hole 120: second porous pad layer
122: dispersion hole 124: main storage hole
125, 127: passage 126: auxiliary storage hole
200: refill container 210: sealing member
300: filling mechanism

The invention claimed is:

1. A porous pad for impregnation of a liquid cosmetic composition, comprising:

a first porous pad layer; and a second porous pad layer disposed under the first porous pad layer, wherein the first porous pad layer comprises an injection hole for injection of the liquid cosmetic composition, and the second porous pad layer comprises a dispersion hole and one or more main storage holes, the dispersion hole being coaxially formed through the second porous pad layer to disperse the liquid cosmetic composition that is injected through the injection hole, the main storage holes being formed through the second porous pad layer in such a way as to be located around a periphery of the dispersion hole and be radially arranged, and the porous pad further comprising: auxiliary storage holes formed in the second porous pad layer to increase a filling amount of the liquid cosmetic composition, each of the auxiliary storage holes having a diameter smaller than that of each of the main storage holes.

2. The porous pad according to claim 1, wherein the first porous pad layer is formed to be thinner than the second porous pad layer.

3. The porous pad according to claim 2, wherein each of the first and second porous pad layers comprises sponge.

4. The porous pact according to claim 1, wherein the dispersion hole of the second porous pad layer is formed to be larger than the injection hole of the first porous pad layer.

5. The porous pad according to claim 4, wherein each of the first and second porous pad layers comprises sponge.

6. The porous pad according to claim 1, wherein a passage is connected between the dispersion hole of the second porous pad layer and each of the main storage holes that are radially located around the periphery of the dispersion hole to guide rapid dispersion and filling of the liquid cosmetic composition.

7. The porous pad according to claim 6, wherein each of the first and second porous pad layers comprises sponge.

8. The porous pad according to claim 1, wherein the auxiliary storage holes formed in the second porous pad layer are distributed at regular intervals between the respective main storage holes so as to guide uniform dispersion of the liquid cosmetic composition.

9. The porous pad according to claim 8, wherein each of the first and second porous pad layers comprises sponge.

10. The porous pad according to claim 1, wherein passages are connected between the main storage holes and the auxiliary storage holes of the second porous pad layer so as to guide rapid dispersion and filling of the liquid cosmetic composition from the central dispersion hole, one passage being connected between each of the main storage holes and each of the auxiliary storage holes.

11. The porous pad according to claim 10, wherein each of the first and second porous pad layers comprises sponge.

12. The porous pad according to claim 1, wherein each of the first and second porous pad layers comprises sponge.

13. A method of impregnating a porous pad with a liquid cosmetic composition, comprising:

receiving a second porous pad layer in a lower portion of a refill container, the second porous pad layer having a dispersion hole formed through a center thereof and one or more main storage holes formed through the second porous pad layer in such a way as to be radially arranged around a periphery of the dispersion hole;

receiving a first porous pad layer to be disposed above the second porous pad layer, with an injection hole formed through the first porous pad layer to inject the liquid cosmetic composition being arranged to be coaxial with the dispersion hole of the second porous pad layer;

fitting a nozzle of a filling mechanism into the injection hole of the first porous pad layer to supply the liquid cosmetic composition;

injecting the liquid cosmetic composition into the dispersion hole of the second porous pad layer using the filling mechanism;

performing filling and impregnating operations so that the liquid cosmetic composition permeates the second porous pad layer while continuing to inject the liquid cosmetic composition through the dispersion hole, and simultaneously storing a predetermined amount of liquid cosmetic composition in each of the main storage holes;

removing the filling mechanism from the first porous pad layer after the filling of the liquid cosmetic composition is completed; and sealing an upper surface of the refill container with a sealing member after the filling mechanism has been removed.

14. The method according to claim 13, wherein a passage is further connected between the dispersion hole and each of the storage holes of the second porous pad layer to improve a flow of the liquid cosmetic composition.

15. The method according to claim 13, wherein auxiliary storage holes are formed in the second porous pad layer that is received in the refill container.

16. The method according to claim 15, wherein each of the main storage holes and each of the auxiliary storage holes around the dispersion hole of the second porous pad layer are connected via a single passage, thus improving the flow of the liquid cosmetic composition.

* * * * *